US006325648B1

(12) United States Patent
Bilezikjian et al.

(10) Patent No.: US 6,325,648 B1
(45) Date of Patent: Dec. 4, 2001

(54) ELECTRICAL CONNECTOR ASSEMBLY WITH COMPLEMENTARY LEVER ASSIST AND TERMINAL DELAY

(75) Inventors: John Peter Bilezikjian, Canton; Jeffery Scott Patterson, Sterling Heights, both of MI (US)

(73) Assignees: Yazaki North America, Inc.; Daimler/Chrysler Corporation

( * ) Notice: Subject to any disclaimer, the term of this patent is extended or adjusted under 35 U.S.C. 154(b) by 0 days.

(21) Appl. No.: 09/778,593

(22) Filed: Feb. 7, 2001

(51) Int. Cl.[7] ..... H01R 13/62
(52) U.S. Cl. ..... 439/157; 439/924.1; 439/924.2
(58) Field of Search ..... 439/157, 372, 439/347, 310, 911, 924.1, 924.2

(56) References Cited

U.S. PATENT DOCUMENTS

| | | | | |
|---|---|---|---|---|
| 5,017,147 | * | 5/1991 | Sugiyama et al. | 439/144 |
| 5,320,544 | * | 6/1994 | Naoto et al. | 439/157 |
| 5,531,605 | | 7/1996 | Taniuchi et al. . | |
| 5,913,691 | | 6/1999 | Clark et al. . | |

* cited by examiner

*Primary Examiner*—P. Austin Bradley
*Assistant Examiner*—James R. Harvey

(74) *Attorney, Agent, or Firm*—Young & Basile

(57) ABSTRACT

An electrical connector assembly is disclosed, the assembly comprising: A first connector member having a first terminal portion and a second terminal portion, the second terminal portion movable relative to the first terminal portion; and a second connector member having first and second terminal portions adapted for mating engagement with the first and second terminal portions, respectively, of the first connector member. A lever, preferably an assist lever for drawing the first and second connector members into a fully mated condition, is provided on the first connector member, the lever defining a first position wherein the lever blocks the second terminal portion of the first connector member from movement into mating engagement with the second terminal portion of the second connector member, and a second position, wherein the second terminal portion of the first connector member is movable into mating engagement with the second terminal portion of the second connector member. The second terminal portion of the first connector member is further cooperative with the lever to secure the lever in a locked position when the second terminal portion of the first connector member is moved into mating engagement with the second terminal portion of the second connector member, such that the first and second connector members cannot be separated until the second terminal portion of the first connector member is moved out of mating engagement with the second terminal portion of the second connector member.

11 Claims, 4 Drawing Sheets

ELECTRICAL CONNECTOR ASSEMBLY WITH COMPLEMENTARY LEVER ASSIST AND TERMINAL DELAY

FIELD OF THE INVENTION

This invention relates generally to electrical connector assemblies and, more specifically, to electrical connector assemblies that permit some terminals to electrically connect or disconnect before other terminals, as well as to electrical connector assemblies having connector position assurance for ensuring the complete connection and preventing the unwanted separation of the electrically connected terminals.

BACKGROUND OF THE INVENTION

Some environments for electrical connectors require that one or more terminals within a connector, for instance pilot terminals, electrically connect with like terminals of a mating connector after a set of one or more terminals within the same connector, for instance primary connectors, electrically connect with like terminals of the mating connector. Conversely, the pilot terminals must also be electrically disconnected before the primary terminals. For example, in some connector systems high voltage circuits must be kept separate from and connected before low voltage circuits if mating and unmating of the low voltage circuits acts to energize and deenergize the high voltage circuits. This prevents shock to the assembler, or electrical arcing damage to the terminals. To achieve these results, initial electric contact points of the pilot terminals are often positioned further back from the mating end of the connectors than the initial electric contact points of the primary terminals. The primary terminals thus engage first, and the pilot terminal engage second. In separation, the order is reversed: The pilot terminals disengage first, and the primary terminals disengage second. Such an offset arrangement is exemplified in U.S. Pat. No. 5,913,691, which discloses a connector assembly having a control circuit and a power circuit in the same male connector. The control circuit connections and power circuit connections are physically offset so that electrical connection of the power supply using the control circuit is made only after the power circuit is connected. This ensures that the power supply is switched on only when the power circuits are already electrically engaged.

An alternative conventional arrangement is to make the pilot terminals significantly shorter than the primary terminals. A lever-type connector with longer terminals for electrical power supply and shorter terminals for signal transmission, causing differences in the timing of terminal connection, is illustrated in U.S. Pat. No. 5,531,605.

These prior art connector configurations limit the types of terminals that can be used in the connector. They require specific types of primary terminals wherein the initial electrical contact points are at the front of the terminal mating features, primary terminals that allow specific over-travel of the contact points, or terminals of different lengths. Moreover, these configurations also result in very short delay times between primary and pilot terminal engagement or disengagement, increasing the risks of shock and damage.

Prior art electrical connectors have also been provided with so-called connector position assurance devices (CPA's) to provide visual and tactile assurance that terminals are properly mated, and to prevent unwanted terminal separation. Conventionally, one form of these CPA's comprises a separate locking tab engageable with the mated connectors of the electrical connector assembly only after the connectors are fully mated and which effectively lock the connectors in the mated condition. Only when the CPA is removed can the connectors and their terminals be separated. While such prior art CPA's are effective, they unfortunately comprise small, separate parts that are prone to loss during connector assembly, and further add time and expense to the manufacture and assembly of these connectors.

Prior art lever connectors have also been provided with assist levers, sometimes referred to as LIF (low insertion force) levers, mounted on one connector to receive portions of a second connector during initial mating and often having cam slot structure to draw the two connectors into a fully mated condition with relatively little force.

SUMMARY OF THE INVENTION

The invention is an electrical connector assembly comprising a first connector member having a first terminal portion and a second terminal portion, the second terminal portion movable relative to the first terminal portion; and a second connector member having first and second terminal portions adapted for mating engagement with the first and second terminal portions, respectively, of the first connector member. A lever is provided on the first connector member, preferably an assist lever for drawing the first and second connectors into a fully mated condition, the lever defining a first position wherein the lever blocks the second terminal portion of the first connector member from movement into mating engagement with the second terminal portion of the second connector member, and a second position, wherein the second terminal portion of the first connector member is movable into mating engagement with the second terminal portion of the second connector member. In the first position of the lever, the first terminal portions of the first and second connector members are not mateably engaged, whereas in the second position of the lever these first terminal portions are mateably engaged. Accordingly, the second terminal portions cannot be brought into mating engagement prior to mating engagement of the first terminal portions.

According to one feature of this invention, the lever includes an arcuate slot, and the second terminal portion of the first connector has a projection cooperating with the arcuate slot in the first position of the lever to prevent sliding movement of the second terminal portion of the first connector member into mating engagement with the second terminal portion of the second connector member.

Per another feature of this invention, the arcuate slot includes an opening adapted to permit the lever to move out of cooperative engagement with the projection as the lever is moved into its second position.

According to still another feature of this invention, when the second terminal portion of the first connector member is moved into mating engagement with the second terminal portion of the second connector member, the second terminal portion of the first connector member cooperates with the lever to secure the lever in a locked position, such that the first and second connector members cannot be separated until the second terminal portion of the first connector member is moved out of mating engagement with the second terminal portion of the second connector member. Per this feature, the second terminal member includes a projection adapted to engage the lever and prohibit the movement thereof after the second terminal portions are mateably engaged, such that the first and second connector members cannot be separated until the second terminal portion of the first connector member is moved out of mating engagement with the second terminal portion of the second connector member. Per one feature of this invention, this projection is part of the projection that cooperates with the arcuate slot to prevent sliding movement of the second terminal portion of the first connector member into mating engagement with the second terminal portion of the second connector member.

BRIEF DESCRIPTION OF THE DRAWINGS

These and other objects, features, and advantages of the present invention will be more clearly understood from the following description, considered in conjunction with the accompanying drawings, of which.

DESCRIPTION OF THE ILLUSTRATED EMBODIMENT

Figure 1:
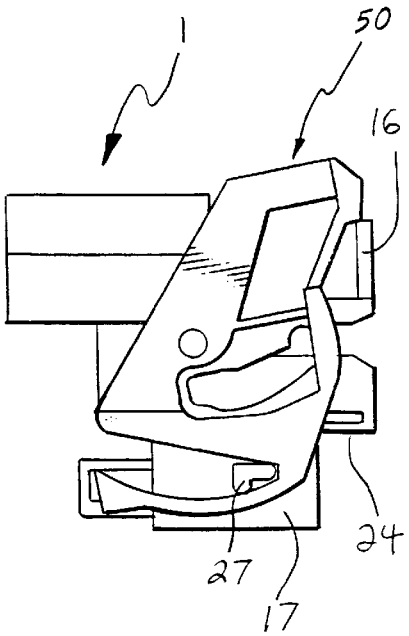
FIG. 1 is a side view of a first connector member according to the connector assembly of the present invention, the lever portion thereof being shown in a first position wherein the second terminal portion is blocked against sliding movement forwardly towards the mating end of the connector member.
Figure 1A:
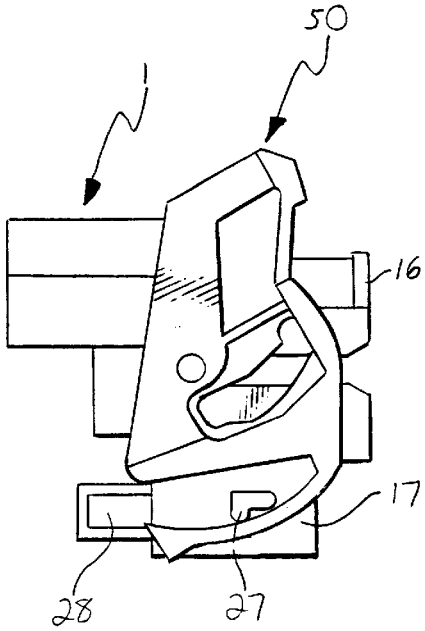
FIG. 1A is a side view of the first connector member, the lever portion thereof being shown moving from the first position and into a second position.
Figure 1B:
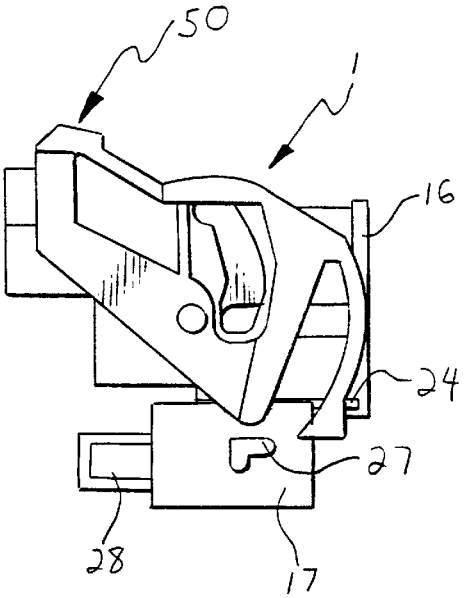
FIG. 1B is a side view of the first connector member, the lever portion thereof being shown in its second position, wherein the second terminal portion is capable of sliding movement forwardly towards the mating end of the connector member.
Figure 1C:
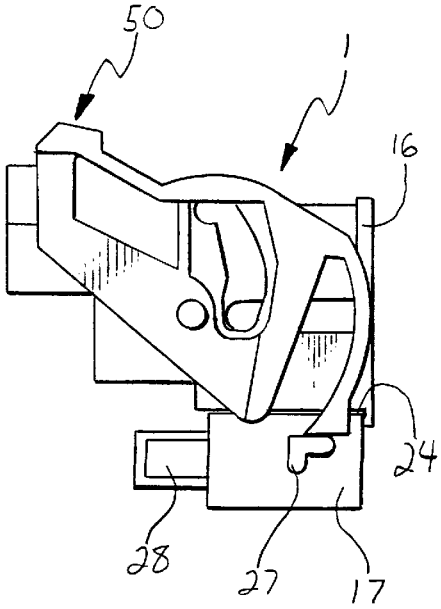
FIG. 1C is a side view of the first connector member, the lever portion thereof being shown in a locked position wherein the second terminal portion cooperates with the lever to secure the lever against movement into its first position.
Figure 3:
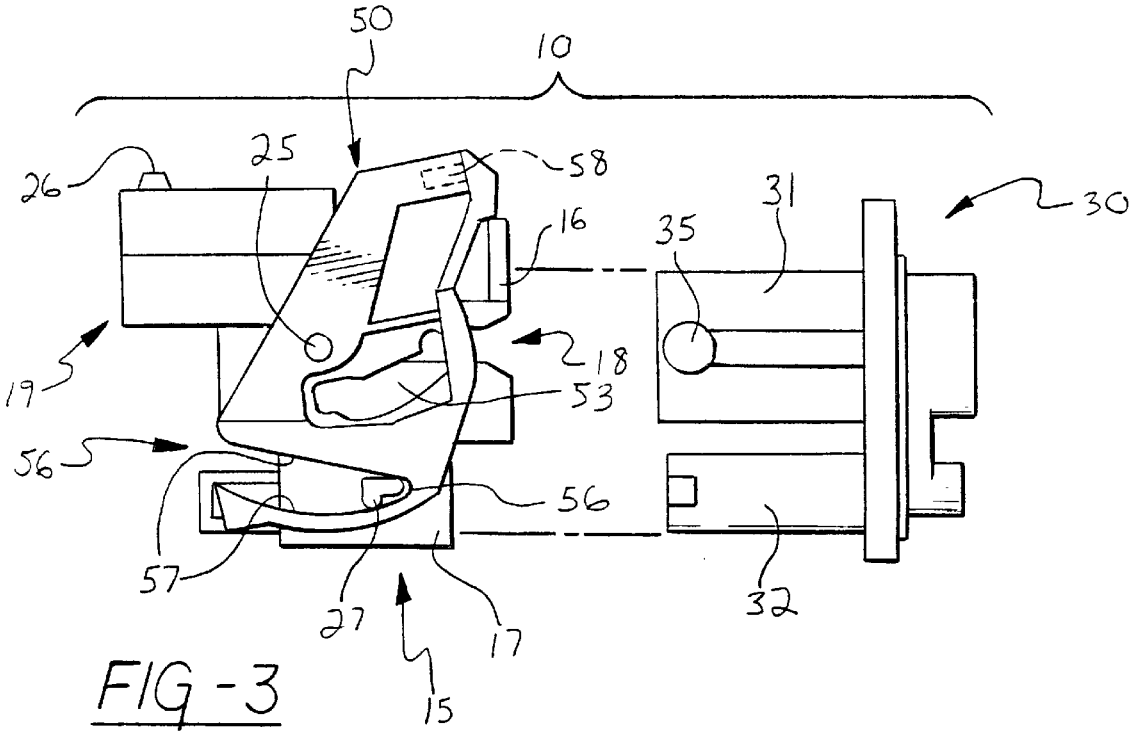
FIG. 3 is a side view of the first connector and a mateable second connector shown in a separated condition.
Figure 4:
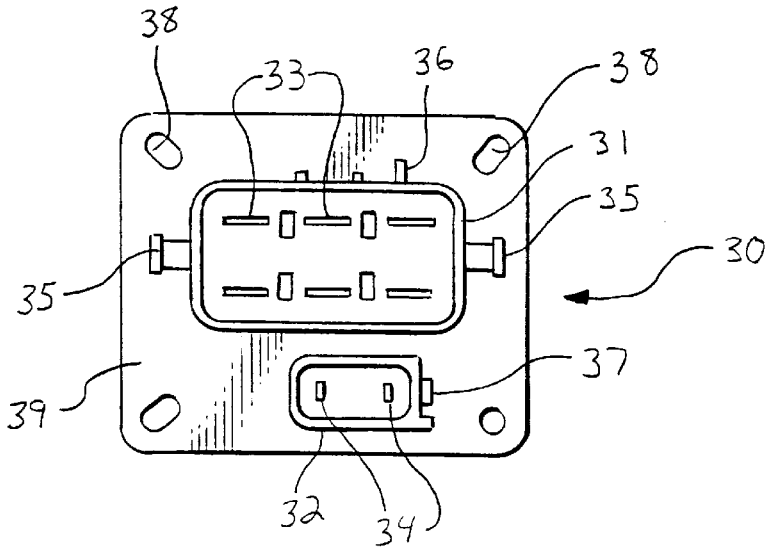
FIG. 4 is a mating end view of the second connector member.

Referring now to the drawings, wherein like numerals indicate like or corresponding parts, the present invention will be seen to generally comprise an electrical connector assembly 10 (FIG. 3) comprising a first connector member 15 having a first terminal portion 16 and a second terminal portion 17, the second terminal portion movable relative to the first terminal portion; and a second connector member 30 having first 31 and second 32 terminal portions adapted for mating engagement with the first 16 and second 17 terminal portions, respectively, of the first connector member 15 (FIG. 3). Referring also to FIGS. 1 through 1C, a mechanical assist lever 50 is provided on the first connector member 15, the lever defining a first position (FIGS. 1 and 1A) wherein the lever 50 cooperates with the second terminal portion 17 of the first connector member 15 to prevent sliding movement of the second terminal portion 17 into mating engagement with the second terminal portion 32 of the second connector member 30 prior to mating engagement of the first terminal portions 16, 31, and a second position (FIG. 1B), wherein the second terminal portion 17 of the first connector member 15 is movable into mating engagement with the second terminal portion 32 of the second connector member 30.

Turning now to FIGS. 1 through 4, the first connector member 15 has a front, connector mating end 18 and a rear, terminal insertion end 19 for receiving electrical wires and their associated terminals. The first terminal portion 16 includes terminal accommodation chambers 20 for receiving electrical terminals, for example primary terminals. A guide groove 21 (FIG. 2) extends along a wall of the first terminal portion 16. The second terminal portion 17 also includes terminal accommodation chambers 22 for receiving electrical terminals, for instance lower voltage pilot terminals. The first 31 and second 32 terminal portions of the second connector member 30 include corresponding terminal accommodation chambers 33 and 34, respectively. The electrical terminals and associated wires are not shown, as they are well known to those skilled in the art. It will also be understood from this disclosure that each of the terminal portions 16, 17, 31, and 32 may comprise any number and kind of accommodation chambers, and so house any number and kind of terminals, depending, on such considerations as connector design and circuit requirements.

In the illustrated embodiment, the first connector member 15 constitutes a female connector for accommodating female terminals and the second connector member 30 constitutes a male connector for accommodating male terminals. This arrangement could, of course, be reversed, with, for instance, the sliding second terminal portion 17 and lever 50 attached to a male connector housing, depending upon specific requirements and needs.

The second terminal portion 17 is mounted on the first terminal portion 16 for sliding movement relative thereto; channels 23 on the second terminal portion ride on rails 24 extending from the first terminal portion 16. As desired, any conventional structure (not shown) may be used to establish a sliding connection between second terminal portion 17 and first terminal portion 16 and to stop the second terminal portion 17 from sliding off the first terminal portion 16 in the direction of the connector mating end 18, and to keep the second terminal portion 17 from sliding off the first terminal portion 16 at the terminal insertion end 19 without significant separating force.

Figure 2:
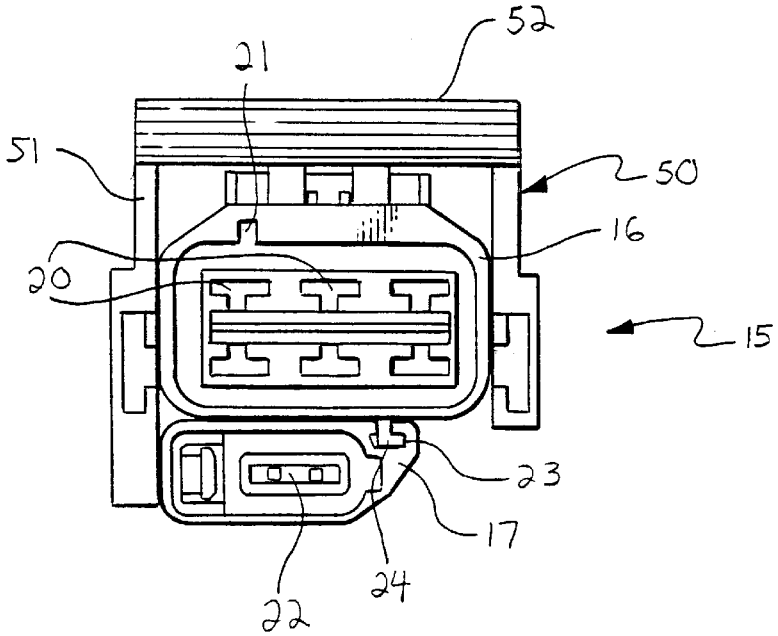
FIG. 2 is a mating end view of the first connector member.

Referring particularly to FIGS. 2 and 3, the U-shaped mechanical assist lever 50 is defined by arms 51 extending vertically along the sides of the connector member 15 and a bridge portion 52 spanning the member 15. The lever 50 is rotatably disposed on the connector member, being mounted on and pivoting about stub shafts 25 protruding from opposite sides of the first connector member 15, the stub shafts being received in apertures on the arms 51. The lever arms 51 each have a cam slot 53. One arm of the lever 50 also has a second, curved or arcuate slot 54. The arcuate slot 54 has a closed end 55, an opposite open end 56, and an inner surface 57. The lever 50 further includes lock extensions 58 on the bridge portion 52 positioned to mate with latch tabs 26 positioned on an upper surface of the connector member 15, in conventional fashion, when the lever 50 is rotated upwardly into the second position thereof Referring again to FIGS. 1 and 1A–1C, a stop tab in the form of an L-shaped projection 27 protrudes from a side of the second terminal portion 17 and is positioned to be located within the slot 54 when the lever 50 is in the first position thereof (FIGS. 1 and 1A). As shown most clearly in FIGS. 1 through 1C, a depressible lock arm 28 is arranged to be accessible by a user. Depressing the lock arm 28 permits sliding movement of the second terminal member 17 out of mating engagement with the second terminal member 32, as explained further herein.

Turning again to FIGS. 3 and 4, cam followers in the form of pins 35 extend from each side of the second connector member 30. A narrow guide ridge 36 projects from an upper surface of the second connector member 30, the guide ridge 36 being slidingly receivable in the guide groove 21 to ensure proper mating alignment of the first and second connector members 15 and 30. A ramp-shaped tab 37 faces outwardly from a side of the second terminal portion 32, the tab 37 engaging the lock arm 28 of the second terminal portion 17 when the second terminal portions 17 and 32 are mateably engaged, as hereinafter described.

Depending on the environment, mounting holes 38 in a frame wall 39 of the second connector member 30 may also be provided in order to mount the connector member 30 to a bulkhead (not shown) before or after the connector members 15 and 30 are mated. If mounted before the connector members are mated, it will be appreciated that all connection movement would be incurred by the first connector member 15 during mating engagement.

Figure 5:
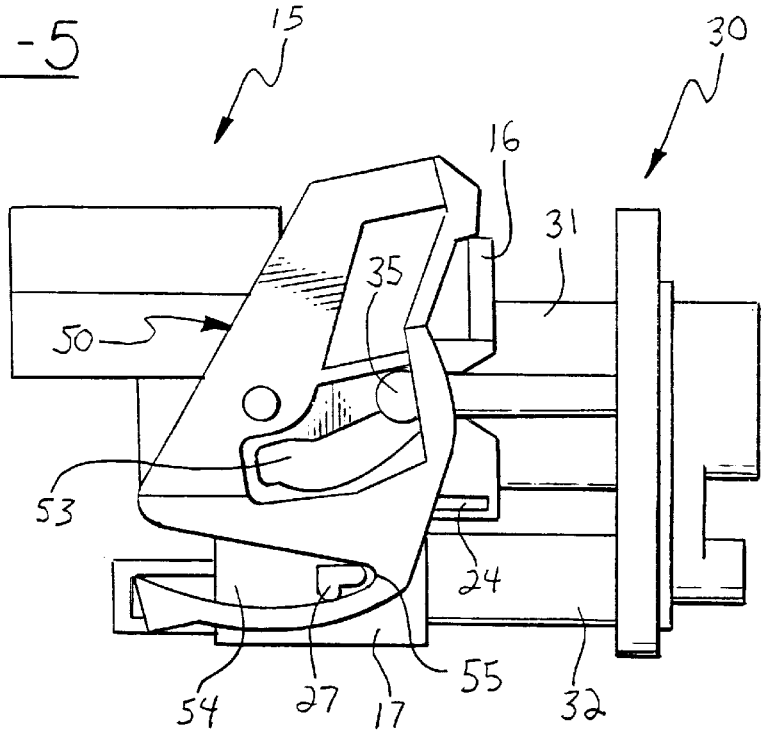
FIG. 5 is a side view of the first and second connector members in a pre-set, electrically disconnected position, the lever being in its first position.

In operation, the first 15 and second 30 connector members are brought into mating proximity, as shown in FIG. 5. The guide groove 21 (FIG. 2) on the first terminal portion 16 of the first connector member 15 is aligned with and receives the guide ridge 36 on the second connector member 30 as the connector members are urged towards mating engagement of the first terminal portions 16 and 31. The cam pins 35 on the second connector member 30 snap into the cam slots 53 of the lever 50. In this terminal unmated position, the connector members 15 and 30 are joined in a pre-set position, with the lever 50 in the first position and the bridge portion 52 of the lever adjacent the connector mating end 18 of the first connector member 15. The L-shaped projection 27 on the second terminal portion 17 of the first connector member abuts against the closed end 55 of the arcuate slot 54. Therefore, the second terminal portion 17 cannot slide forward into mateable engagement with the second terminal portion 32 of the second housing 30.

Figure 6:
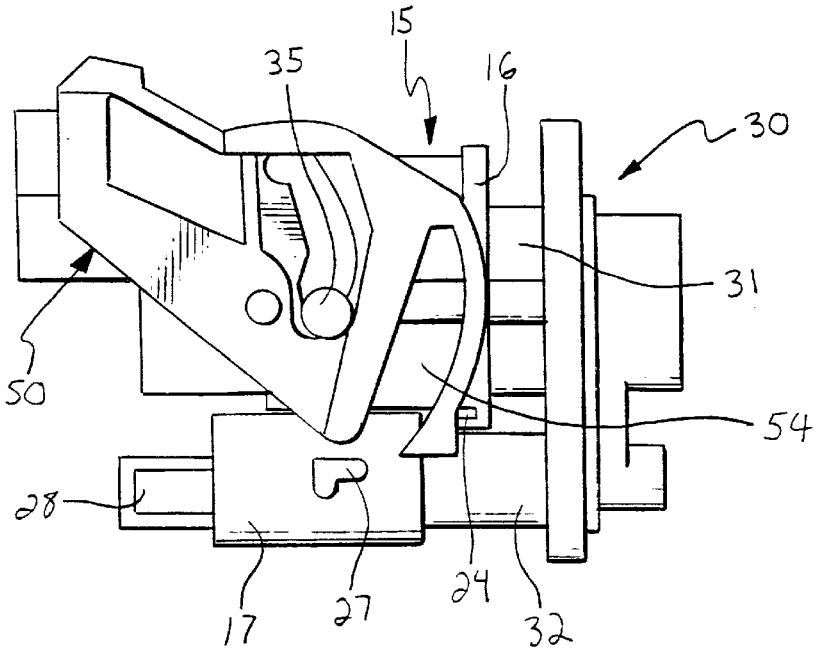
FIG. 6 is a side view of the first and second connector members with the first terminal portions mateably engaged, and the lever being in the second position thereof

To mate the first terminal portions 16 and 31, the bridge portion 52 of the lever 50 is grasped and rotated toward the terminal insertion end 19 of the first connector housing 15. The cam following pins 35 are urged along the cam slots 53, pulling the second connector member 30 toward the first connector member 15, and thereby bringing the first terminal portions 16, 31 into mating engagement. However, the inner surface 57 of the arcuate slot 54 prevents the second terminal portion 17 of the first connector member 15 from sliding forward into mating engagement with the corresponding second terminal portion 32 of the second connector member 30. If an attempt is made to slide the second terminal portion 17 towards mating engagement with the second terminal portion 32, the projection 27 abuts against the inner surface 57 of the closed end 55. The slot 54 is curved so the lever 50 can be rotated without interference from the projection 27; the projection simply travels along the slot to the open end 56. When the lock extensions 58 on the bridge portion are brought into contact with the latch mechanisms 26 and the lever 50 is secured with the first terminals portions 16, 31 in mating engagement (FIG. 6), the slot 54 has moved out of cooperative engagement with the L-shaped projection 27 of the second terminal portion 17. Only in this condition can the second terminal portion 17 be slid forward into mating engagement with the corresponding second terminal portion 32 (FIG. 7).

Figure 7:
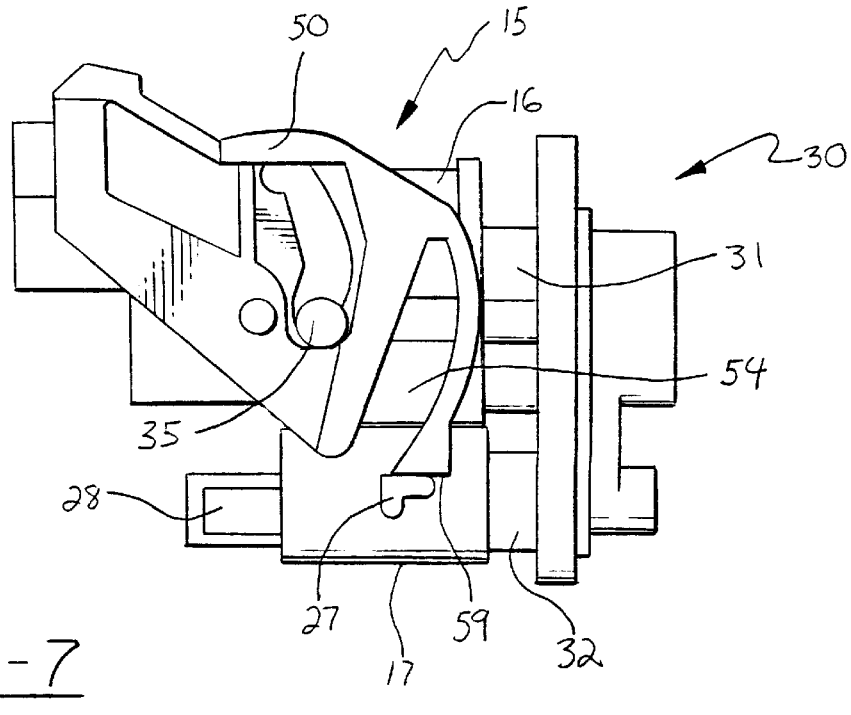
FIG. 7 is a side view of the first and second connector members with both the first and second terminal portions thereof mateably engaged, and the lever in the locked position thereof.

Referring to FIG. 7, it will be appreciated that because the L-shaped projection 27 is now confronting a stop surface 59 of the lever 50, the lever cannot be rotated back into its first position until the lock arm 28 is released from the ramp-shaped tab (not shown in FIG. 7) and the second terminal portion 17 is moved out of mating engagement with the second terminal portion 32. Thereafter the lever 50 can be rotated, after the latch tabs 26 and lock extensions 58 have been separated, into its first position. Movement of the lever back into this first position urges the first terminal portions 16 and 31 away from each other and out of mating engagement, thereby disconnecting the electrical terminals. Also as the lever is rotated, the projection 27 reenters the arcuate slot 54 through the open end 56, and the projection again cooperates with the slot to prevent sliding movement of the second terminal portion 17 back into mating engagement with the second terminal portion 32. This ensures the second terminal portions 17 and 32 will not reconnect as the first terminal portions 16 and 31 are being disconnected.

It will be appreciated from the foregoing that the present invention allows use of the same type and size of terminals within each terminal portion. For example, in a circuit where the lower voltage pilot terminals in second terminal portion 17 act to energize and deenergize the primary terminals in the first terminal portion 16, the possibility of shock while mating the connectors is mostly eliminated. This is because the configuration of the terminal portions, and the sliding movement of the second terminal portion, acts to ensure that any lower voltage circuits are not connected while higher voltage circuits are being connected or disconnected. Similarly, the occurrence of electrical arcing during connection or disconnection and the resultant damage to the electrical terminals is significantly reduced. The required space for the circuits is also small because high and low voltage circuits can be safely present in one connector assembly. Moreover, the configuration of the second terminal portions permits these terminal portions to be mated at any time after the first terminal portions are mated, thereby eliminating the risks associated with short delay time between mating of the primary and pilot terminals such as can occur in prior art devices. Finally, the inventive electrical connector assembly is inexpensive and easily adaptable to conventional mechanical assist lever designs.

Since minor changes and modifications varied to fit particular operating requirements and environments will be understood by those skilled in the art, this invention is not considered limited to the specific examples chosen for purposes of illustration. Rather, the invention is meant to include all changes and modifications which do not constitute a departure from the true spirit and scope of this invention as claimed in the following claims and as represented by equivalents to the claimed invention.

The invention in which an exclusive property or privilege is claimed is defined as follows:

1. An electrical connector assembly comprising:

a first connector member having a first terminal portion and a second terminal portion, the second terminal portion movable relative to the first terminal portion;

a second connector member having first and second terminal portions adapted for mating engagement with the first and second terminal portions, respectively, of the first connector member;

a lever provided on the first connector member, the lever defining a first position wherein the lever blocks the second terminal portion of the first connector member from movement into mating engagement with the second terminal portion of the second connector member, and a second position, wherein the second terminal portion of the first connector member is movable into mating engagement with the second terminal portion of the second connector member.

2. The connector assembly of claim 1, wherein the lever includes a slot, and the second terminal portion of the first connector member includes a projection cooperating with the slot in the first position of the lever to prevent sliding movement of the second terminal portion of the first connector member into mating engagement with the second terminal portion of the second connector member.

3. The connector assembly of claim 2, wherein the slot includes an opening adapted to permit the lever to be moved out of cooperative engagement with the projection and into the second position thereof.

4. The connector assembly of claim 3, wherein, when the second terminal portion of the first connector member is moved into mating engagement with the second terminal portion of the second connector member, the second terminal portion of the first connector member cooperates with the lever to secure the lever in a locked position, such that the first and second connector members cannot be separated until the second terminal portion of the first connector member is moved out of mating engagement with the second terminal portion of the second connector member.

5. The connector assembly of claim 4, wherein the projection is adapted to engage the lever and prohibit the movement thereof into the first position after the second terminal portions are mateably engaged, so that the first and second connector members cannot be separated until the second terminal portion of the first connector member is moved out of mating engagement with the second terminal portion of the second connector member.

6. An electrical connector assembly comprising:

a first connector member having a first terminal portion and a second terminal portion, the second terminal portion movable relative to the first terminal portion;

a second connector member having first and second terminal portions adapted for mating engagement with the first and second terminal portions, respectively, of the first connector member;

a lever provided on the first connector member, the lever defining a first position wherein the first and second connector members are freely separable, a second position wherein the first terminal portions of the first and second connector members are mateably engaged, and a locked position wherein when the second terminal portion of the first connector member is moved into mating engagement with the second terminal portion of the second connector member, the second terminal portion of the first connector member cooperating with the lever to prevent separation of the first and second connector members until the second terminal portion of the first connector member is moved out of mating engagement with the second terminal portion of the second connector member.

7. The connector assembly of claim 6, wherein the second terminal portion of the first connector member includes a projection adapted to engage the lever and prohibit movement thereof from the second position into the first position after the second terminal portions are mateably engaged, such that the first and second connector members cannot be separated until the second terminal portion of the first connector member is moved out of mating engagement with the second terminal portion of the second connector member.

8. An electrical connector assembly comprising:

a first connector member having a first terminal portion and a second terminal portion, the second terminal portion movable relative to the first terminal portion;

a second connector member having first and second terminal portions adapted for mating engagement with the first and second terminal portions, respectively, of the first connector member;

a lever provided on the first connector member, the lever defining a first position wherein the lever blocks the second terminal portion of the first connector member from movement into mating engagement with the second terminal portion of the second connector member, and a second position, wherein the second terminal portion of the first connector member is movable into mating engagement with the second terminal portion of the second connector member; and wherein, when the second terminal portion of the first connector member is moved into mating engagement with the second terminal portion of the second connector member, the second terminal portion of the first connector member cooperates with the lever to secure the lever in a locked position thereof, wherein the first and second connector members cannot be separated until the second terminal portion of the first connector member is moved out of mating engagement with the second terminal portion of the second connector member.

9. The connector assembly of claim 8, wherein the lever includes a slot, and the second terminal portion of the first connector includes a projection cooperating with the slot in the first position of the lever to prevent sliding movement of the second terminal portion of the first connector member into mating engagement with the second terminal portion of the second connector member.

10. The connector assembly of claim 9, wherein the slot includes an opening adapted to permit the lever to be moved out of cooperative engagement with the projection and into second position thereof.

11. The connector assembly of claim 10, wherein the projection is adapted to engage the lever and prohibit the movement thereof into the first position after the second terminal portions are mateably engaged, so that the first and second connector members cannot be separated until the second terminal portion of the first connector member is moved out of mating engagement with the second terminal portion of the second connector member.

* * * * *